US005573615A

United States Patent [19]

Vigneau et al.

[11] Patent Number: 5,573,615

[45] Date of Patent: Nov. 12, 1996

[54] METHOD AND APPARATUS FOR TAIL SEALING OF CONVOLUTELY WOUND WEBS

[75] Inventors: Richard J. Vigneau, Green Bay; Gerald W. Buxton, Shawano; Richard C. Dvorak, Green Bay, all of Wis.

[73] Assignee: Paper Converting Machine Company, Green Bay, Wis.

[21] Appl. No.: 437,810

[22] Filed: May 9, 1995

[51] Int. Cl.[6] ..... B32B 31/00

[52] U.S. Cl. ..... 156/184; 156/191; 156/448; 156/456; 156/458; 242/533.4

[58] Field of Search ..... 242/532.2, 533.4, 242/535.1, 541.2, 542, 548.4; 156/446, 448, 449, 450, 457, 458, 184, 187, 191, 193, 518, 456

[56] References Cited

U.S. PATENT DOCUMENTS

| | | | |
|---|---|---|---|
| 3,044,532 | 3/1960 | Ghisoni . | |
| 3,179,348 | 4/1965 | Nystrand et al. . | |
| 3,393,105 | 7/1968 | Tellier, Jr. . | |
| 3,532,572 | 10/1970 | Herman | 156/457 X |
| 3,926,299 | 12/1975 | Bradley et al. . | |
| 4,026,752 | 5/1977 | Hartbauer et al. . | |
| 4,299,642 | 11/1981 | Berkholtz | 242/542 X |
| 4,475,974 | 10/1984 | Perini . | |
| 4,552,316 | 12/1985 | Dropczynski et al. | 242/532.2 X |
| 4,693,766 | 9/1987 | Stauffer | 156/446 X |
| 4,909,452 | 3/1990 | Hertel et al. . | |
| 4,963,223 | 10/1990 | Biagiotti . | |
| 5,242,525 | 9/1993 | Biagiotti . | |
| 5,259,910 | 11/1993 | Biagiotti . | |

FOREIGN PATENT DOCUMENTS

| | | |
|---|---|---|
| 50-35562 | 11/1975 | Japan . |
| 1495445 | 12/1977 | United Kingdom . |

*Primary Examiner*—James Engel

*Attorney, Agent, or Firm*—Tilton, Fallon, Lungmus & Chestnut

[57] ABSTRACT

A method and apparatus for sealing the tail of a convolutely wound log which includes the steps of providing a turret rotatably mounted in a frame and having a plurality of circumferentially spaced apart three-roll clusters, feeding a log into a first cluster while positioning an immediately previously fed log with a draped tail in another cluster adjacent glue apparatus and while ejecting an even earlier fed log now rewound from still another cluster, and providing a log infeed mechanism adjacent the turret and including a pair of relatively movable rollers, feeding logs sequentially into the pair of said rollers, rotating the infeed rollers to orient the log tail in a predetermined position, by providing a mark on said log prior to the feeding step, and detecting said mark to orient the tail in a predetermined position.

35 Claims, 4 Drawing Sheets

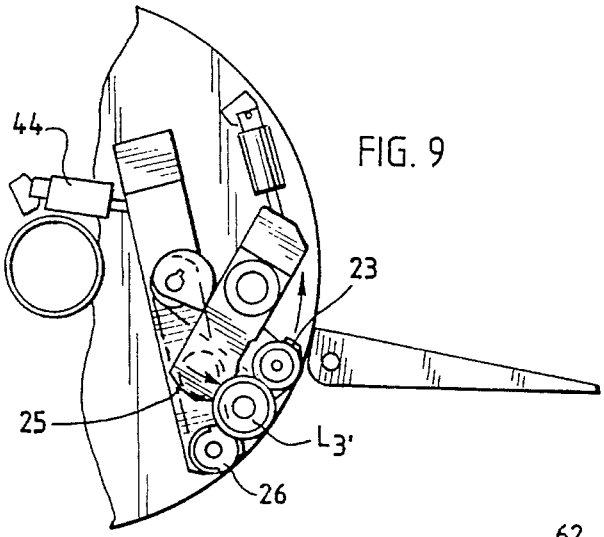
FIG. 9
FIG. 10
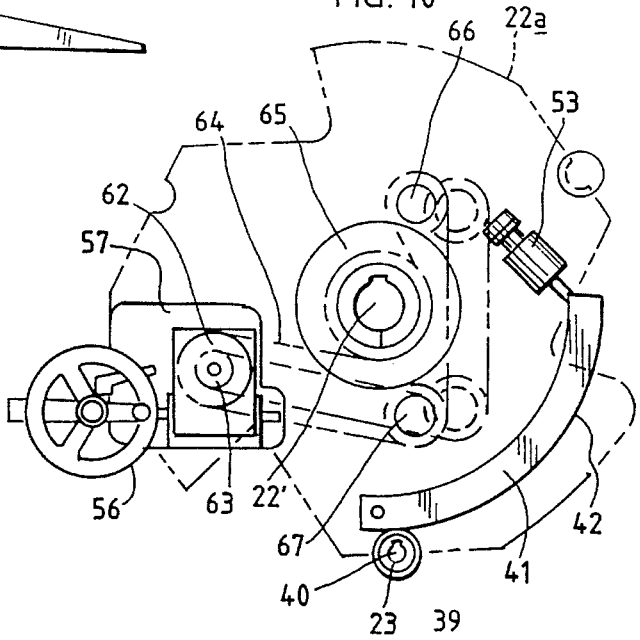
FIG. 11
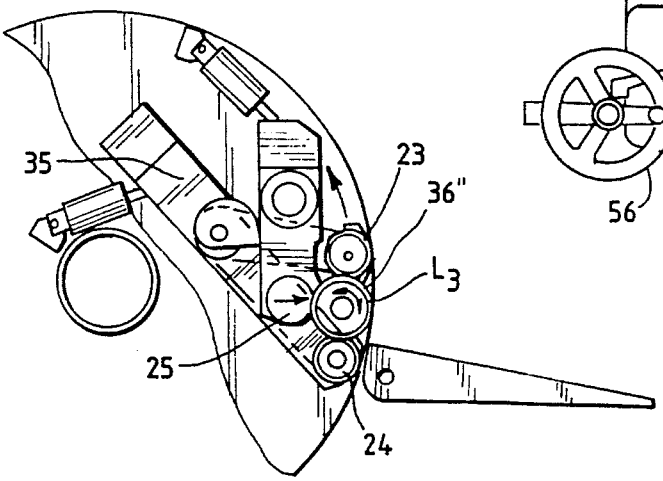
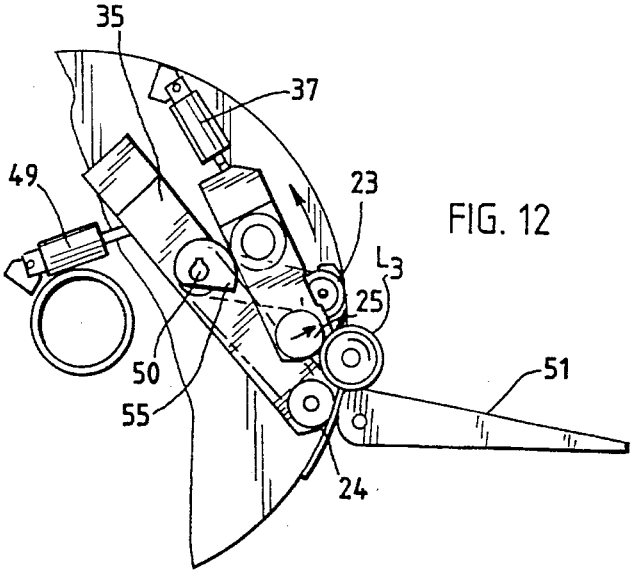
FIG. 12

METHOD AND APPARATUS FOR TAIL SEALING OF CONVOLUTELY WOUND WEBS

BACKGROUND AND SUMMARY OF INVENTION

This invention relates to method and apparatus for tail sealing of convolutely wound webs and, more particularly, to elongated logs such as are produced in manufacturing bathroom tissue and kitchen toweling products.

Webs are often "rewound" into retail sized logs. As exemplified by bathroom tissue and kitchen toweling, the webs from the paper machine are normally wound into a jumbo roll of 5 to 10 feet in diameter and 100 to 200 inches in axial length. These jumbo rolls are then transferred to a "rewinder" where they are rewound into the consumer sized diameter product, viz., 5 to 10 inches in diameter but with an axial length of the original jumbo roll. During this rewinding, the web is normally transversely perforated on 4–½" centers for bathroom tissues and 11" for kitchen toweling. Subsequently, these logs are transversely sawed into shorter axial lengths, i.e., 4–½" for bathroom tissue and 11" for kitchen toweling so that the "squares" of web material can be unwound and detached. The rewinding normally results in a "loose" tail on the outside of the log which could interfere with either or both of the transverse sawing and the ultimate roll packaging. Therefore, for the last 35 years, tail sealing has been performed and illustrative of an early commercial machine is U.S. Pat. No. 3,044,532. This provided the basic technology of unwinding the tail from the completed log, introducing adhesive between the unwound tail and the underlying convolution, and then rewinding the tail on the log.

Two widely employed improvements are seen in U.S. Pat. Nos. 3,393,105 where adhesive was applied to the tail and 4,016,752 where adhesive was applied to the convolution underlying the tail.

A Japanese 1975 Publication 50-35562 discloses and adhesive applicator which is positioned underneath a log to apply adhesive to one or both of the draped, tail and underlying log convolution.

A 1977 British Publication 1 495 445 discloses a tail sealer where the tail is immobilized by vacuum so as to permit an orbiting brush to apply adhesive to the underlying log.

U.S. Pat. No. 4,475,974 discloses a chain conveyor for positioning a log in different stations for unwinding, glue application and rewinding. U.S. Pat. No. 4,963,223 discloses an orbiting tail sealer with stations for unwinding and gluing. U.S. Pat. No. 5,242,525 discloses an in-line conveyor consisting of two parallel belts for handling the logs during tail sealing. U.S. Pat. No. 5,259,910 shows another conveyor-type tail sealer where adhesive is applied from the underside of the log.

According to the invention, a rotating processing wheel or turret is provided which receives a wound log and which clamps the log for unwinding, adhesive application and rewinding during the orbiting of the turret. This provides a method for sealing the tail of a convolutely wound log which includes providing a processing wheel rotatably mounted in a frame and having a plurality of circumferentially spaced three-roll clusters, feeding into a first cluster a wound log while positioning an immediately previously fed log with a draped tail in another cluster adjacent glue apparatus and while ejecting an even earlier fed log now rewound from still another cluster.

The invention also provides a novel infeed mechanism and procedure which is advantageous both with the above described turret sealer and those employing other sealing techniques. The infeed employs roller means in combination with sensor means to provide a predetermined orientation of the tail of a wound log so that there is no need in the sealer itself for complicated mechanisms to insure proper tail orientation incident to gluing.

Other objects and advantages of the invention may be seen in the details of construction and operation set forth in the ensuing specification.

BRIEF DESCRIPTION OF DRAWING

The invention is described in conjunction with the accompanying drawing, in which—

FIG. 9 is a fragmentary side elevational view showing the processing wheel approaching the end of its second index;

FIG. 10 is a side elevational view somewhat schematic of a log diameter cam adjustment drive and wind-up member as seen generally along the line 10-10 of FIG. 3 but with the profile of the turret added in broken line;

FIG. 11 is a view like FIG. 9 but showing the processing wheel at its end of its second index where the log is about to be discharged; and FIG. 12 is a view like FIGS. 9 and 11 but showing the log being discharged and the processing wheel starting its third and final index.

DETAILED DESCRIPTION

Figure 1:
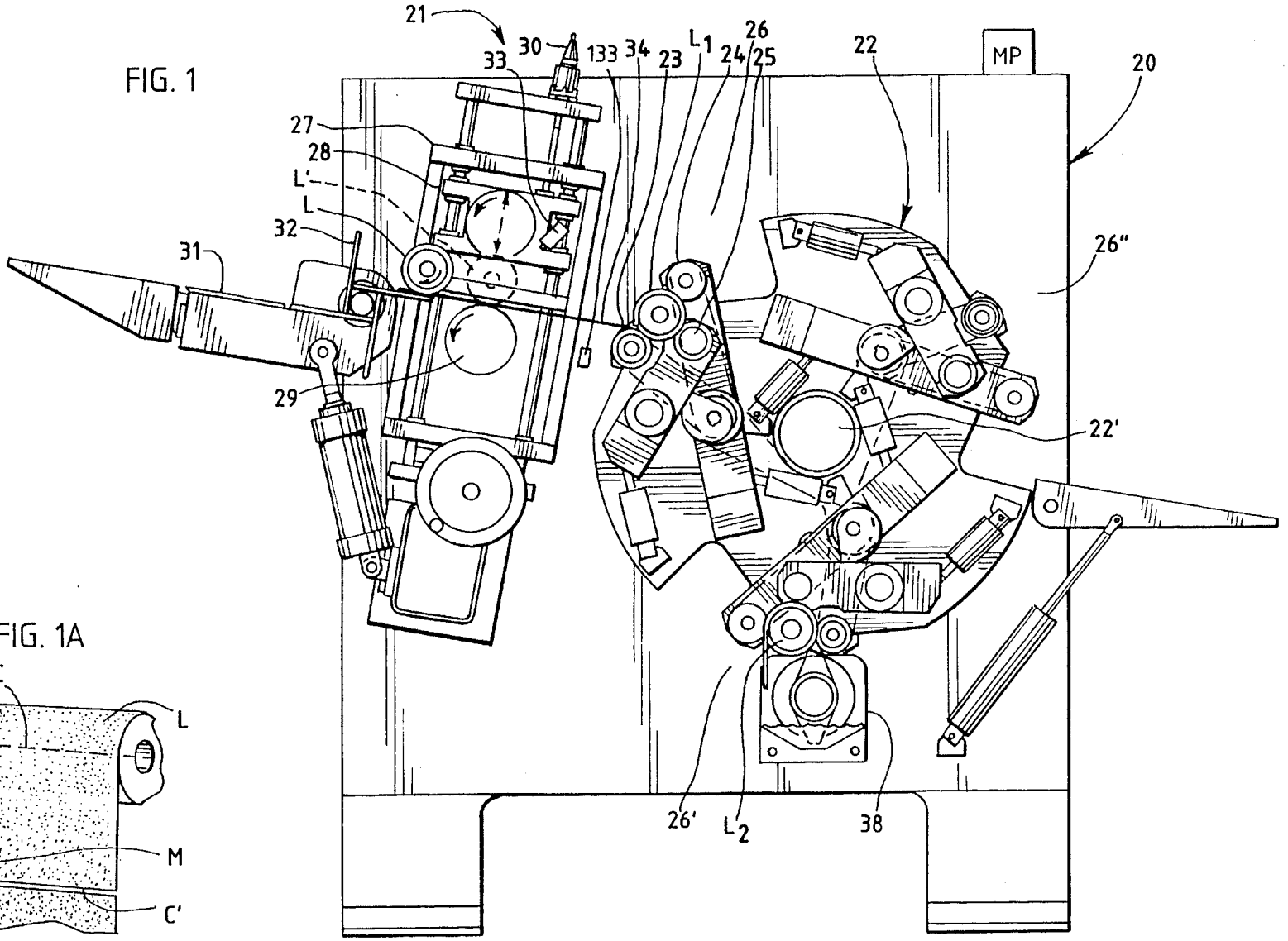
FIG. 1 is a side elevation of a tail sealer including a processing wheel carrying the circumferentially spaced three roll clusters.
Figure 3:
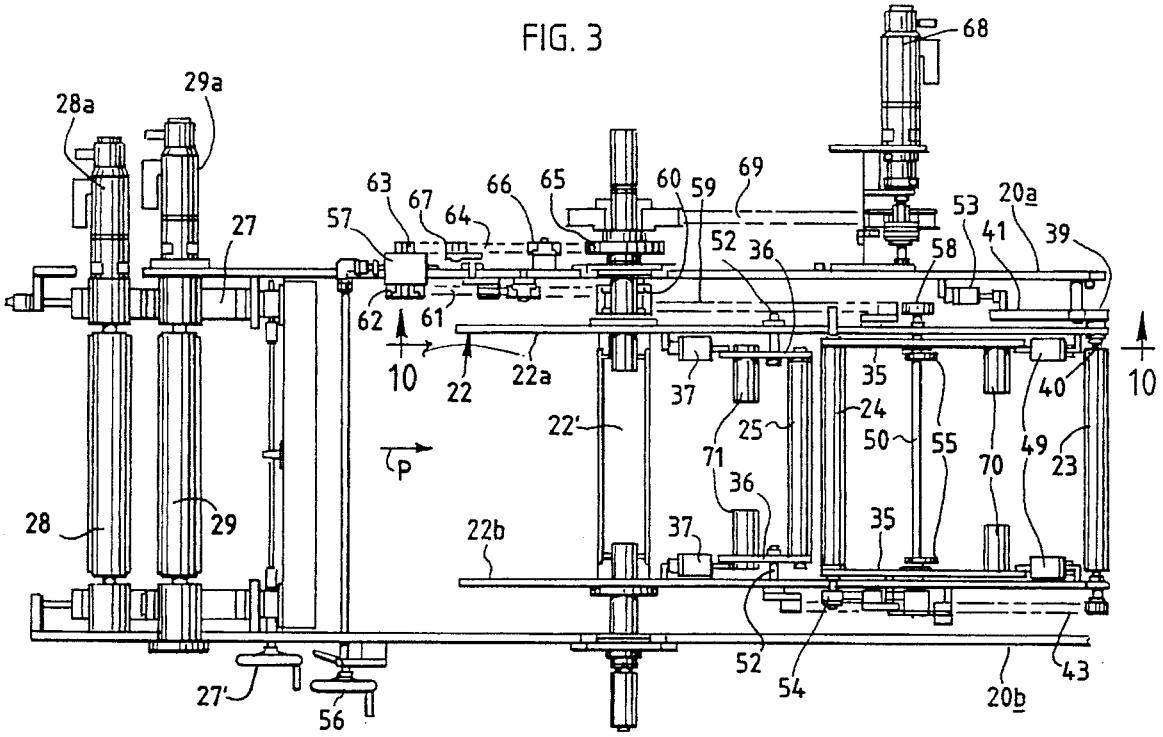
FIG. 3 is a developed plan view of the sealer seen in FIG. 1.

Referring first to FIG. 1, the numeral 20 designates generally the frame of the tail sealing apparatus which includes the infeed station generally designated 21 and the turret generally designated 22. As seen in FIG. 3, the frame includes a pair of side frames **20*a* and 20*b* which defines a generally longitudinally extending path P. Extending between the side frames and rotatably supported therein is a cross shaft 22' which is part of the turret 22**.

Turret Construction

As seen in FIG. 3, the turret 22 includes a pair of spaced end plates **22*a* and 22*b*. Because FIG. 3 is a developed view, i.e., parts are extended so that various transversely extending rolls, rollers, etc. are shown side-by-side rather than one above the other, the right hand portions of the plates 22***a*, 22*b* are much longer than the corresponding left hand portions. The plate 22*a* is seen in actual profile in broken line in FIG. 10.

The departure of the developed view of FIG. 3 from the actual relationship in FIG. 1 can be especially appreciated from a comparison of the showings of the three roll clusters. Each three roll cluster includes rolls 23, 24 and 25. These are grouped in the triangle shown so as to clamp a log $L_1$—see the upper left center portion of FIG. 1. But in FIG. 3, the rolls 23, 24 and 25 are spaced apart in the right hand portion thereof.

In the illustration given, the turret 22 has three stations: a log clamping station 26 (see FIG. 1), a tail gluing station 26' for log $L_2$ (also see FIG. 1) and a log discharge station 26" for log $L_3$ (see FIG. 11) located at about 11 o'clock, 6 o'clock and 2 o'clock, respectively. It is the log clamping station into which the logs are fed sequentially—after first passing through the log infeed station 21 which includes a subframe 27.

Infeed Station

As seen in the upper left portion of FIG. 1, a log L is seen advancing toward the infeed station 21 which includes two rollers 28 and 29 rotatably mounted on subframe 27. These are spaced apart a distance to accommodate the diameter of the log having been wound in the usual accompanying rewinder (not shown). A suitable rewinder is either of the center wind type (U.S. Pat. No. 3,179,348) or surface wind type (U.S. Pat. No. 4,909,452).

Adjustment of the spacing between rollers 28, 29 is made by handwheel 27' (see lower left in FIG. 3) which spaces the upper roller 28 away from the lower roller 29 a distance slightly less than the target diameter for traction. Initially, the upper roller 28 runs slightly faster than the lower roller 29 to initiate a forward movement of the log into the spacing or nip between the rollers 28, 29. When the log reaches the center between the rollers 28, 29 (as seen in dashed line and designated L'), its position is sensed by a sensor 30 mounted on subframe 27. The sensor includes a cell and may be of type Tempsonics available from MTS Sensors Div. located in Charlotte, N.C. When the log is in the dashed position of FIG. 1, i.e., with its axis aligned with the axes of rollers 28, 29, the sensor 30 signals the upper roller 28 to match the speed of the lower roller 29, thereby temporarily holding the log L in the nip between the two rollers 28, 29. The rotation of the rollers 28, 29 and therefore log L is achieved by motors 28*a*, 29*a*—see the upper left portion of FIG. 3.

More specifically, when the log L enters the infeed station 21, the upper roller 28 floats to log diameter, the position feed back sensor 30 detects the diameter and sends a signal to a master processor MP (see upper right in FIG. 1) to determine where to stop the log to locate the tail. This can also be done with manual input via the operator and using a photoeye to detect the log position in the rollers 28, 29. In some instances, it may be advantageous to eliminate the diameter sensing and install the rollers 28 and 29 in fixed positions.

The master processor MP in the illustration given is a type PIC 900 available from Giddings & Lewis located in Fond du Lac, Wis. It is advantageous in regulating or controlling all the functions of the tail sealing apparatus starting from the time the logs advance down infeed ramp 31, through control paddle wheel 32, through the infeed station 27 and the three operations 26, 26' and 26" of the turret 22. The paddle wheel 32 operates both to advance logs sequentially in proper timed relation and to maintain the axes of the logs perpendicular to the path P (see FIG. 3).

Figure 1A:
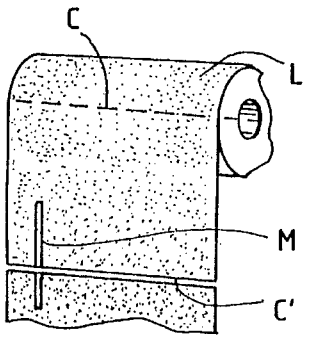
FIG. 1A is a fragmentary perspective view of a wound log as it comes out of a rewinder (not shown)

In the illustrated embodiment, tail detection makes use of an ink marker (prelocated during the winding operation) on the tail of the log. This is illustrated in FIG. 1A where a fragment of a log L is shown. During winding, the web ultimately being wound into log L is cross perforated as at C. Also during the wind, a longitudinally extending stripe or marking M is applied to extend on both sides of a predetermined or preselected line of cross perforation. The preselected line C' is determined by the desired sheet count and at the end of the wind the web is cut off at this line C'.

More particularly, a short pulse of ink is sprayed on the web in the rewinder line before cutoff. The finished wound product then has several inches of ink partway around its circumference with a very defined end where the cutoff occurs. Since the log is always rotated in a wind up rotation it is easy to locate the end of the ink defining the tail.

As the log L is located between the rollers 28, 29 and rotated, the marker M which may be ultra violet (UV) ink, is sensed by the photoelectric eyes 33 (one being seen in the center of FIG. 1), and the log rotated to a specific predetermined position. Once the log reaches this position or orientation, the lower roller 29 stops rotating. This results in the upper roller 28 ejecting the log out of the nip and toward the turret 22.

Summarizing, once the log diameter is determined and the log is held between the rollers 28, 29 to locate the tail, the tail is looked for with the photoelectric eyes 33. When the tail is detected, the log is stopped in a rotational position or orientation such that when the product is discharged it will come to rest in the three roll cluster of the process wheel with the tail located. Location of the tail by ink eliminates the need to blow open the tail via the conventional air blast, and shortens the cycle time as less rotational time is required. This could also be done with an ink sensible in the visual range of the human eye, say black ink, again providing it was done adjacent a trim edge.

The infeed subframe 27 also includes a discharge ramp 34 (still referring to FIG. 1) on which the log L can roll as it proceeds toward and into the three roll cluster 26. At this time, the log L has its tail in a specific location as a result of the sensing and rotation operation. This can be appreciated from a consideration of FIG. 4 where the log $L_1$ has a short but discernible tail $T_1$ and which, during rotation of the turret 22 becomes lengthened to $T_2$ on log $L_2$—see FIG. 5.

By sensing the diameter of the log and having determined the length the log must travel on the ramp 34, the programmer MP can fix the position of the log tail in position L' so that there is a desired amount of tail $T_1$ at the beginning of the rotation of the turret 22. Thus, the infeed means just described in detail is advantageous in providing each log with a precisely located tail when the log starts the tail sealing operation by entering the three roll cluster of the turret. Once the log is in the turret, it is advantageous to avoid any further rotation of the log to properly position the tail for glue application—thereby simplifying the overall mechanism. So, what the invention provides is a log infeed which orients a log with its tail in a predetermined position relative to the turret 22. This results in a precision in the glue application, again without the need for rotating individual logs about their own axes while in the three roll cluster before glue application. If less precision is acceptable, a possible variant for the described infeed is to use a conventional air blast for opening the tail to locate it for proper positioning but again letting the rotation of the turret generate the necessary tail length.

Still further, the air blast can be used to advantage to develop precision in tail orientation as an alternative to the UV or visual ink marking described above. By locating a photo eye as at 133 in FIG. 1, the tail is detected and advanced to a position based on log diameter such that the tail is in a correctly draped position after rolling into the three roll cluster.

Turret Operation

As indicated previously, the turret 22 has three indexes or discrete rotational steps. The first occurs after the log L is clamped in the three roll cluster 25 (consisting of rolls 23, 24 and 25) as seen in FIG. 1. To achieve this, the roll 24 is mounted on pivot arms 35 (see FIGS. 2–4), the roll 25 mounted on pivot arms 36, but the roll 23 is fixed in position (not pivotable) on the turret 22.

First Indexing

Figure 4:
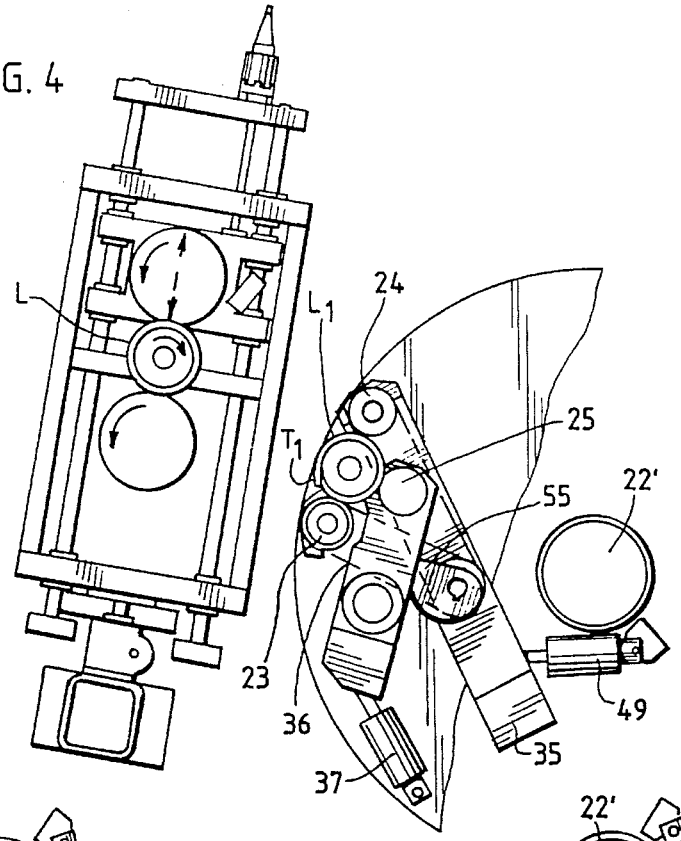
FIG. 4 is a fragmentary side elevational view of the sealer with the processing wheel starting to index and where a subsequent log has entered the infeed station.
Figure 5:
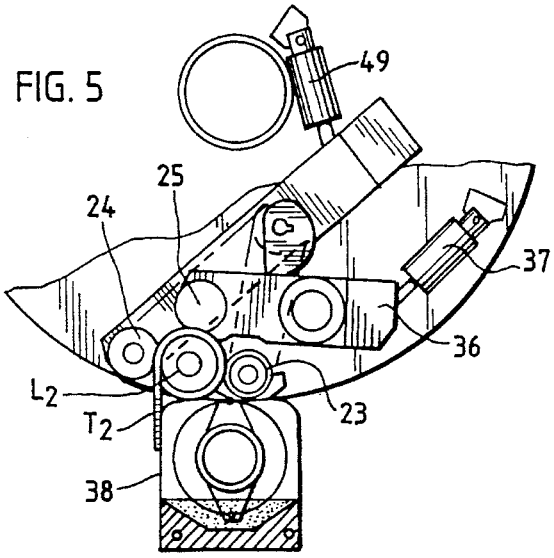
FIG. 5 is a fragmentary side elevational view showing the processing wheel ending its first index.

The first indexing is illustrated by the turret positions starting with FIG. 1 and proceeding through FIGS. 4 and 5. In going from the FIG. 1 to the FIG. 5 position, it is possible to "cull" a defective log. Log removal from the tail sealing apparatus is advantageously achieved by unclamping the three roll cluster 26 to allow the log to fall by gravity to the floor or into a waste receiver. Normally, this is achieved by a signal from the processor when it cannot locate a tail because of a defect and actuates fluid cylinders 37 which pivot arms 36 to move roll 25 away from the log (see FIGS. 2 and 3). Optionally, all the cylinders may be of the pneumatic type.

It will be noted that near the start of the index (FIG. 4), there is very little of the tail $T_1$ which is freely draped. However, by the time the FIG. 5 position is reached, there is a substantial drape in the tail $T_2$ because of the rotation of the turret 22. At the end of the first index, the log $L_2$ (FIG. 5) is just upstream of the adhesive-applying apparatus 38 which is at the nadir of the orbit of the three-roll clusters 26. In some instances, it may be advantageous to augment gravity by applying an air blast to the log to facilitate unwinding of the tail.

Second Indexing

Figure 6:
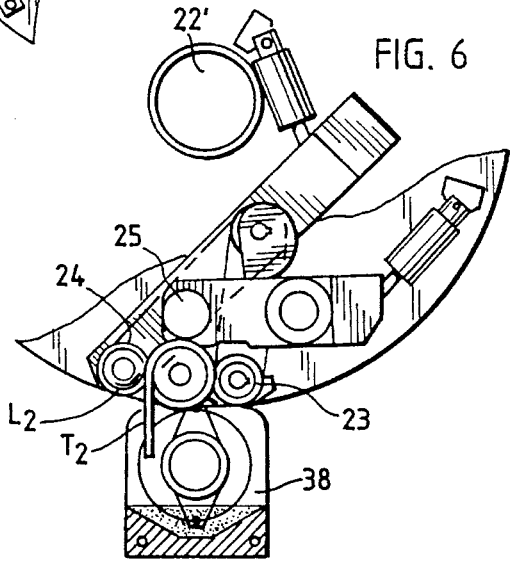
FIG. 6 is a view like FIG. 4 but slightly later in the sealing cycle showing the processing wheel beginning its second index.

At about the time of the showing in FIG. 6, a pulley 39 on the shaft 40 of the fixed roll 23 (see the upper right portion of FIG. 3) of the cluster holding the log $L_2$ comes into contact with an arcuate member 41 which provides a wind-up surface 42—see FIG. 10. The rotation of roll 23 is communicated to roll 24 via timing belts 43 and 44 entrained on double pulley 45—see FIG. 2. Roll 25 is an idler. So there are three areas of rotational contact with the log when it proceeds from the $L_2$ position of FIG. 6 to the $L_3$ position of FIG. 11. Meanwhile, the next log $L_1$ is loaded in station 26 and the previous log discharged at 26".

After the log has reached the FIG. 5 position, the next rotational step has the three roll cluster moving with the counterclockwise rotation of the turret which, by virtue of the pulley 39 on the shaft 40 engaging member 41, rotates the log clockwise. This "walks" the log over the glue station 38 (see FIG. 6) and proceeds to wind the tail up.

Figure 7:
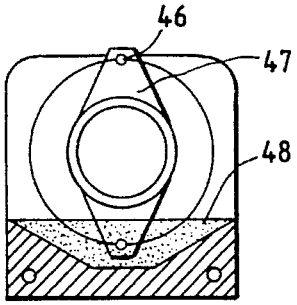
FIG. 7 is a fragmentary side elevational view of the adhesive applicator seen in FIGS. 5 and 6.
Figure 8:
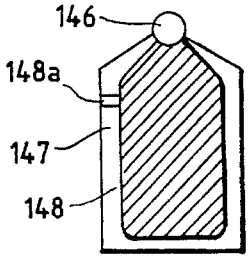
FIG. 8 is a fragmentary sectional view of a modified form of adhesive applicator.

In some instances, it is advantageous to apply the adhesive to the tail. In either case, the constructions of FIGS. 7 and 8 may be employed. In FIG. 7, a coated wire 46 is stretched between a pair of end plates one of which is designated 47 in FIG. 7. The wire is rotated in a pan of adhesive as at 48 and up to a top vertical position for the product, i.e., either log or tail, to be "walked over" the glued wire, thereby applying the adhesive. An alternative is to make use of a rod applicator as shown in FIG. 8 where a rod 146 is positioned at the top of a housing 147 containing adhesive 148. The rod 146 applies adhesive in a precise amount by variable speed of the rod itself and variable flow rate of the adhesive as introduced through port 148a.

The next step in the sealing process is depicted in FIGS. 9, 11 and 12 wherein the log is rotated by contacting the pulley 39 with the surface 42 until discharge position 36" is reached. Between the positions of FIGS. 9 and 12, culling also can occur—again by unclamping the log $L_3$ (see FIG. 9), this time by actuating cylinders 49 (see also FIG. 3) which pivot the arms 35 carrying the roll 24. As the process wheel continues toward the end of its second segment of rotation, the tail is wound up and located in a specific position. The log $L_3$ is then ejected from the three-roll cluster as seen in FIGS. 11 and 12 with the tail glued in position for the accumulator downstream (not shown but see U.S. Pat. No. 3,926,299).

In FIG. 11, the rolls 23, 24 and 25 are still in clamping relation with the log $L_3$. But in FIG. 12, the roll 24 has moved away from the log $L_3$ by virtue of the cylinders 49 extending their piston rods to pivot the arms 35 about pivot shaft 50. At the same time, actuation of cylinders 37 moves the roll 25 outwardly (compare FIGS. 11 and 12) to push log $L_3$ onto exit ramp 51.

Third Indexing

Thereafter, the empty three-roll cluster 26" is ready to rotate into the pick-up position 26 shown in FIG. 1 for another log. The other two stations work simultaneously so that all the operations are being done at the same time.

Structural Features

Figure 2:
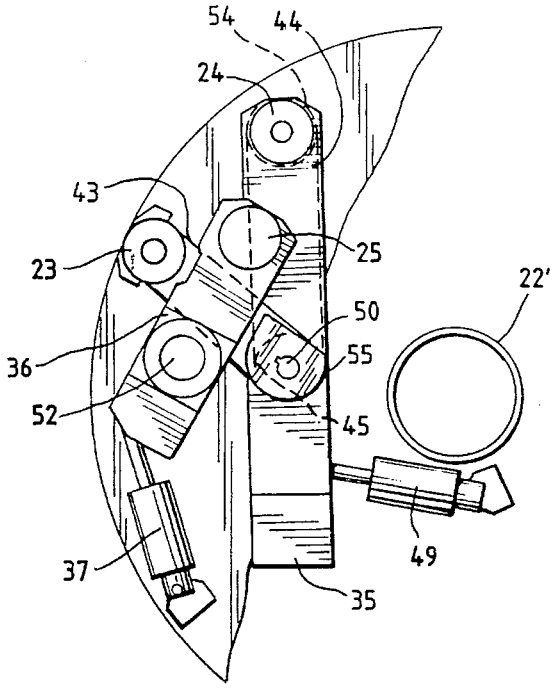
FIG. 2 is a fragmentary enlarged side elevational view of the three roll cluster seen in the upper left portion of FIG. 1.

Referring now to FIGS. 2 and 3, the numerals 37 designate fluid pressure cylinders that pivot the arms 36 around a pivot shaft 52. These are preferable pneumatic cylinders. This brings the roll 25 in and out of bearing relation with the log L. More particularly, in the illustration given, air pressure is employed to extend the rod of the cylinder 37 so that the roll 25 can move in to clamp the log L. The piston within the cylinder 37 then retracts to proper log diameter position. There is spring retraction on the cylinder 37 so as to open the cradle developed by the roll cluster 26 and meet the next log being fed into the sealer turret.

In somewhat similar fashion a cylinder 49 is provided for each arm 35 which together carry the roll 24. The cylinders 49 are again air loaded to close onto the log L and the air pressure is varied so as to vary the clamping force. Again, the cylinders are equipped with spring retractors so as to open the clamping roll incident to discharging a completely finished log, culling a log or receiving a log to be tail sealed.

The roll 23 is in a fixed position on the turret 22 and does not pivot relative to the turret as do the rolls 24 and 25. As the turret 22 rotates, the roll 23 is driven from an external source by virtue of being equipped with the pulley 39—see the upper right hand portion of FIG. 3 which rides against the surface 42 of the arcuate member 41 (see FIG. 10). The member 41 is positioned for proper contact with the pulley 39 by virtue of a pneumatic pressure cylinder 53—still referring to FIG. 10.

As seen in FIG. 2 the rotation of the roll 23 is communicated via belt 43 to the double pulley 45 rotatably mounted on the pivot shaft 50 of the arms 35. In turn, a drive 44 connects the double pulley 45 with a pulley 54 on the roll 24—see FIG. 2.

Also mounted coaxially with pivot shaft 50 of arm 35 for roll 24 are cams 55 (two positions—see FIG. 3). These can be oriented to a different angular position so as to properly locate arms 36 for the diameter of log L. The condition of cams 55 is achieved by handwheel 56—seen at the lower left in FIG. 3. This provides a static adjustment for phasing the cam condition via differential gear box 57 (compare FIGS. 3 and 10).

The cams 55 rotate as part of the turret 22 and are connected via pulley 58 and belt 59 to an idler pulley 60 on shaft 22'. In turn the pulley 60 is connected by belt 61 to pulley 62 which is part of the differential gear box 57. A pulley 63 is provided on the opposite side of the gear box which is driven by belt 64 from pulley 65 fixed to shaft 22'—all as seen in the upper center part of FIG. 3 and also in FIG. 10.

In FIG. 10 it is seen that the belt drive 64 has tensioners 66 and 67. These are also identified in FIG. 3. Other belt drives herein also have tensioners which are shown but not identified to avoid undue complication of the views.

Thus, when the turret 22 indexes 120°, the pulley 65 is also rotated—and, as a result, the drives 58–65 keep the cams 55 stationary in relation to the three roll clusters as they orbit. The time the cam orientations change (rotation of shaft 50) is when the handwheel 56 is rotated which changes the phasing between pulleys 62 and 63.

Initially, as seen in FIG. 2, the arms 36 are rotated counterclockwise relative to the showing in FIG. 6. In this condition, the roll 25 is in condition to receive a log—each cylinder 37 in FIG. 2 having its rod retracted relative to the showing in FIG. 4. By having the roll 25 pivoted to this counterclockwise position in FIG. 2, it will dampen and slow the log as it enters the three roll cluster. Then, the arms 36 move clockwise about their pivot 52 to the FIG. 4 position where they abut the cams 55. This dampening of the log keeps the roll from skidding on the surface of the roll 23. This insures that the tail location is maintained against bouncing, for example, as it enters the three roll cluster 26.

Summary of Operation

The inventive method for sealing the tail of a convolutely wound log includes the steps of providing a turret 22 rotatably mounted in a frame 20. The turret 22 is driven by servo motor 68 (see FIG. 3 at the upper right) via drive 69. The turret 22 has a plurality of circumferentially spaced apart three-roll clusters 23, 24, 25, feeding a log $L_1$ into a first cluster 26 while positioning an immediately previously fed log $L_2$ also with a draped tail $T_2$ in another cluster 26' adjacent glue apparatus 38 and while ejecting an even earlier fed (but now rewound) log $L_2$ from still another cluster 26". The log is advanced into the three roll cluster 26 with its tail in a predetermined orientation $T_1$. This obviates the need for rotating the rolls 23, 24, 25 prior to glue application. The rolls 24 and 25 are pivotally mounted on arms 35 and 36 which carry counterweights 70 and 71, respectively—see the right central portion of FIG. 3. These counterweights assist in limiting the influence of gravity on the clamping forces. Other means for this purpose may be employed.

The illustrated infeed mechanism 27 is not only advantageous in connection with the illustrated sealer but can provide logs having precisely oriented tails for use with other sealers. The infeed procedure includes providing a pair of relatively movable rollers 28, 29, feeding logs sequentially into the pair of rollers, and rotating the infeed rollers to orient the log tail T in a predetermined position. The tail orientation is done by providing a mark on the log prior to the feeding step, and sensing or detecting the mark which may be visible or a UV ink. An advantage of the ink tail detecting is that it permits higher speed in that it does not require time to rotate the log to blow the tail open and find it.

The advantages of the invention re:

(1) Elimination of multiple belts which mark the product and are difficult to maintain and access.

(2) Elimination of the vacuum tail handling system required by some prior art.

(3) Provides two built-in cull stations within the tail seal unit.

(4) Permits automatic tail positioning within the unit eliminating an additional station for wind-up and tail locating.

(5) Permits multiple methods of applying adhesive including line applicator, spray, and linear gun.

While in the foregoing specification, a detailed description of the invention has been set down for the purpose of illustration, many variations in the details hereingiven may be made by those skilled in the art without departing from the spirit and scope of the invention.

I claim:

1. A method for sealing the tail of a convolutely wound log comprising the steps of providing a turret rotatably mounted in a frame and having a plurality of circumferentially spaced apart three-roll clusters, feeding a log into a first cluster while positioning an immediately previously fed log with a draped tail in another cluster adjacent glue apparatus and while ejecting an even earlier fed log now rewound from still another cluster.

2. The method of claim 1 in which said feeding step includes providing a log infeed mechanism adjacent said turret and including a pair of relatively movable rollers, feeding logs sequentially into said pair of rollers, and rotating said infeed rollers to orient the log tail to a predetermined position.

3. The method of claim 2 in which said steps include providing an elongated mark on said log prior to said feeding step, and detecting said mark to orient the tail in a predetermined position.

4. The method of claim 3 in which said mark providing step includes using UV ink.

5. The method of claim 3 in which said providing step includes ink in the visible range and on a trim end portion of the log.

6. The method of claim 1 in which said steps include sensing the log diameter and adjusting the roller spacing to accommodate the log diameter.

7. The method of claim 1 in which said steps include moving one roll of said three roll cluster during said feeding step to dampen the force of a log entering said three roll cluster.

8. The method of claim 1 in which said steps include providing a pivotal mounting for at least two of said rolls, and pivoting said two rolls to clamp a log in said cluster.

9. The method of claim 8 in which said steps include relatively culling a log from said log cluster by unclamping said log as said cluster approaches said glue apparatus.

10. The method of claim 8 in which said steps include relatively culling a log from said log cluster by unclamping said log as said cluster leaves said glue apparatus.

11. The method of claim 1 which includes positioning said glue apparatus adjacent the nadir of the orbital movement of said clusters resulting from the rotation of said processing wheel.

12. The method of claim 11 in which said steps include equipping said glue apparatus with a glue containing pan having a wire orbiting through said glue at about the nadir of the wire orbit and contacting a portion of said log about the zenith of the wire orbit.

13. The method of claim 11 in which said steps include equipping said glue apparatus with a glue filled container having a tapered top opening, a rod rotatably mounted in said opening and coated with glue, said rod being positioned in the path of a portion of said log as it passes said glue applicator rod.

14. The method of claim 13 in which said rod is rotated.

15. The method of claim 1 in which said steps include rotating said rolls after said log is glued and prior to ejecting the same in order to wind up said tail.

16. The method of claim 1 in which said steps include providing three stations for the infeed, glue application and log ejection spaced 120° apart in the direction of rotation of said processing wheel.

17. The method of claim 1 in which said steps include providing a cam for controlling the position of one of said rolls so as to form a pocket clamping a log at three circumferentially spaced apart areas.

18. A method for sealing the tail of a convolutely wound log comprising the steps of providing a longitudinally extending path including an infeed station and a sealing station, equipping said infeed station with a pair of relatively movable rollers, feeding logs sequentially into said pair of rollers, rotating said rollers to orient the log tail to a predetermined position and rolling each log in said path into said sealing station.

19. The method of claim 18 in which said steps include providing a mark on said log prior to said feeding step, and detecting said mark to orient the tail in a predetermined position.

20. Apparatus for sealing the tail of a convolutely wound log comprising a frame, a glue apparatus on said frame, a turret rotatably mounted in said frame and equipped with a plurality of circumferentially spaced apart three-roll clusters, means on said frame for feeding a log into a first cluster while positioning an immediately previously fed log with a draped tail in a second cluster adjacent said glue apparatus, and means on said frame for ejecting an even earlier fed log now rewound from a third cluster.

21. The apparatus of claim 20 in which a log infeed mechanism is mounted on said frame adjacent said processing wheel and includes a pair of relatively movable rollers, means for feeding logs sequentially into said pair of said rollers, means operably associated with said frame for rotating said infeed rollers to orient the log tail in a predetermined position.

22. The apparatus of claim 19 in which said frame is equipped with a pivotal mounting means for at least two of said rollers for clamping a log in each cluster.

23. The apparatus of claim 21 in which said frame is equipped with means for selectively culling a log from a log cluster by unclamping said log as the cluster approaches said glue apparatus.

24. The apparatus of claim 21 in which said frame is equipped with means for selectively culling a log from a log cluster by unclamping said log as the cluster leaves said glue apparatus.

25. The apparatus of claim 20 in which means are provided on said turret for moving one roll of said three roll cluster when a log is fed into said cluster to dampen the force of the log entry.

26. The apparatus of claim 20 in which means for rotating said turret are operably associated with said frame for rotating said clusters through an orbit, said glue apparatus being mounted on said frame adjacent the nadir of said orbit.

27. The apparatus of claim 26 in which said glue apparatus is equipped with a glue containing pan equipped with a wire and means for orbiting said wire through said glue at about the nadir of the wire orbit and contacting a portion of said log at about the zenith of the wire orbit.

28. The apparatus of claim 26 in which said glue apparatus is equipped with a glue filled container having a tapered top opening, a rod rotatably mounted in said opening and coated with glue, said rod being positioned in the path of a portion of said log as it passes said glue applicator rod.

29. The apparatus of claim 28 in which said glue apparatus is equipped with means for rotating said rod.

30. The apparatus of claim 20 in which said frame is equipped with means for rotating said rolls after said log is glued and prior to ejecting the same in order to wind up with tail.

31. The apparatus of claim 20 in which said frame includes three stations for the infeed, glue application and log ejection spaced 120° apart in the direction of rotation of said turret.

32. The apparatus of claim 20 in which said frame includes a cam for controlling the position of one of said rolls so as to form a pocket clamping a log at three circumferentially spaced apart areas.

33. Apparatus for sealing the tail of a convolutely wound log comprising a frame defining a longitudinally extending path including an infeed station and a sealing station, said infeed station including a pair of relatively movable rollers mounted on said frame, means on said frame for feeding logs sequentially into said pair of rollers, means on said frame for rotating said rollers to orient the log tail to a predetermined position and means on said frame for rolling each log in said path into said sealing station.

34. The apparatus of claim 33 in which control means are operably associated with said frame for correlating the tail orientation in said infeed station with the tail orientation in said sealing station.

35. The apparatus of claim 33 in which means are operably associated with said frame for sensing the log diameter and for adjusting the roller spacing to accommodate the log diameter.

* * * * *